United States Patent [19]

Gühne et al.

[11] Patent Number: 4,785,492

[45] Date of Patent: Nov. 22, 1988

[54] FLOOR CLEANING APPARATUS

[75] Inventors: Wieland Gühne, Remscheid; Uwe Kemker, Wuppertal; Wolfgang Tröger, Pulheim; Hans-Joachim Birr, Wuppertal; Paul Michel, Ennepetal; Renate Friedrichs, Wuppertal, all of Fed. Rep. of Germany

[73] Assignee: Vorwerk & Co. Interholding GmbH, Wuppertal, Fed. Rep. of Germany

[21] Appl. No.: 117,288

[22] Filed: Nov. 4, 1987

[30] Foreign Application Priority Data

Nov. 4, 1986 [DE] Fed. Rep. of Germany ..... 3637535

[51] Int. Cl.[4] ..... A47L 5/30

[52] U.S. Cl. ..... 15/380

[58] Field of Search ..... 15/380, 381

[56] References Cited

U.S. PATENT DOCUMENTS

| | | | |
|---|---|---|---|
| 1,472,208 | 10/1923 | Dawer | 15/320 |
| 1,769,796 | 7/1930 | LePage | 15/380 X |
| 2,926,370 | 3/1960 | Wessel | 15/380 X |

FOREIGN PATENT DOCUMENTS

| | | | |
|---|---|---|---|
| 514903 | 3/1921 | France | 15/380 |

*Primary Examiner*—Chris K. Moore

*Attorney, Agent, or Firm*—Walter Ottesen

[57] ABSTRACT

The invention is directed to a floor cleaning apparatus which includes a nozzle-like structure for a vacuum cleaner. The apparatus is for vacuum cleaning and polishing hard floors and is moved by the operator in a desired direction. The apparatus includes a chassis defining a longitudinal axis and at least two working plates for working on the surface of the hard floor. The working plates are movably mounted on the chassis so as to perform respective reciprocal movements counter to each other and in a direction ninety degrees to the desired direction in which the apparatus is moved by the operator. The plates conjointly define a total depth extending in the direction of the longitudinal axis of the chassis and work plate takes up one-third of this depth. The other one of the work plates takes up two-thirds of this depth. The work plates have a flat shape and at least one of the work plates is pervious to air. The work plates are sealed at their edges and are mounted on the apparatus by means of elastic bearings.

11 Claims, 3 Drawing Sheets

FLOOR CLEANING APPARATUS

FIELD OF THE INVENTION

The invention relates to a floor cleaning apparatus for vacuum cleaning and polishing hard floors. The floor cleaning apparatus is moved in a working direction determined by the operator and includes work tools mounted thereon for performing reciprocating stroke movements in mutually opposite directions. The work tools are mounted parallel to each other and are displaced ninety degrees with respect to the direction in which the apparatus slides across the surface to be worked.

BACKGROUND OF THE INVENTION

Floor cleaning apparatus of the kind described above have the purpose of distributing a polishing medium applied to a hard floor and to polish the surface of the hard floor. In addition, it is intended that these apparatuses remove loose dust or residues of the polishing medium by vacuum cleaning in advance of the polishing.

Such apparatus are disclosed, for example, in German published patent application DE-OS No. 92 616 wherein a hard floor cleaning apparatus is disclosed having two working plates which act parallel to the direction in which the operator moves the apparatus. The work plates of this apparatus perform a stroke-like movement. Vacuum cleaning means are also part of this apparatus.

With respect to such apparatus, it is a disadvantage that a poor polishing result is obtained especially on a marble floor which is conditioned by the parallel stroke and slide movement. A further disadvantage is that a large pushing force is required which is caused by the weight of the apparatus itself; likewise, a complex engineering effort is required in order to reduce the vibrations felt by the operator, that is, to achieve a condition where there is a balance of the masses.

SUMMARY OF THE INVENTION

It is an object of the invention to provide an apparatus for vacuum cleaning and polishing hard floors which requires a reduced pushing force and is free of vibrations as well as provides a high polishing effect including into the corners of a room.

The advantages of the invention are especially seen in that the polishing capacity which is wanted is achieved with a low power consumption while at the same time maintaining a guidance which is free of vibration thereby achieving a low pushing force for the apparatus. Further advantages are seen in the ease with which the work plates can be exchanged by the user and in the suction achieved with the apparatus at the front, corners and sides of the unit.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
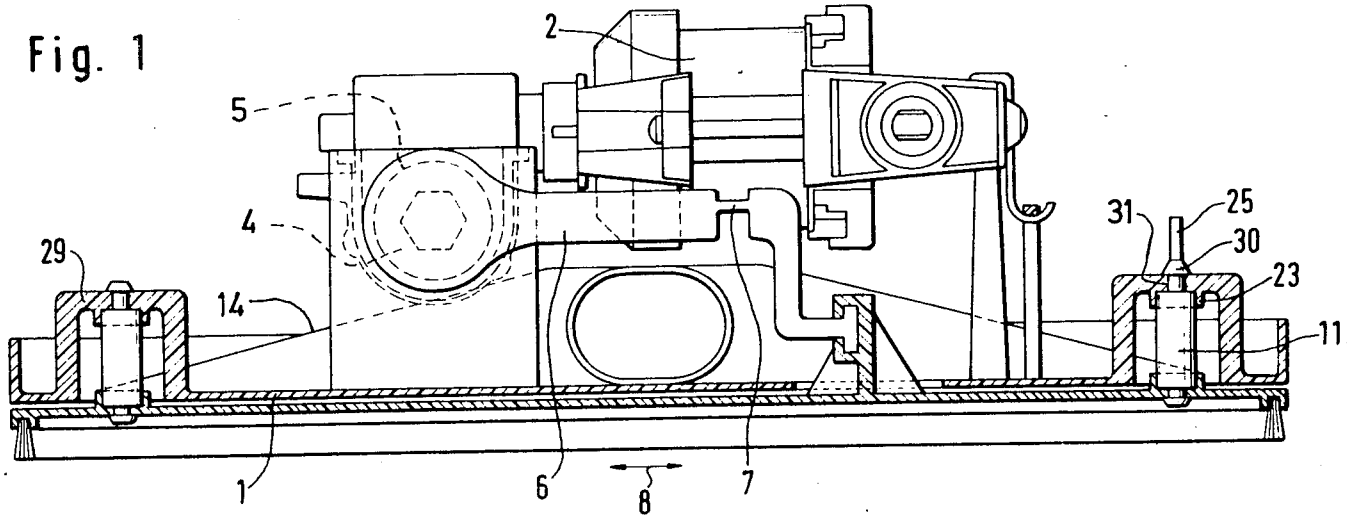
FIG. 1 is a front elevation view of the floor cleaning apparatus according to the invention.
Figure 2:
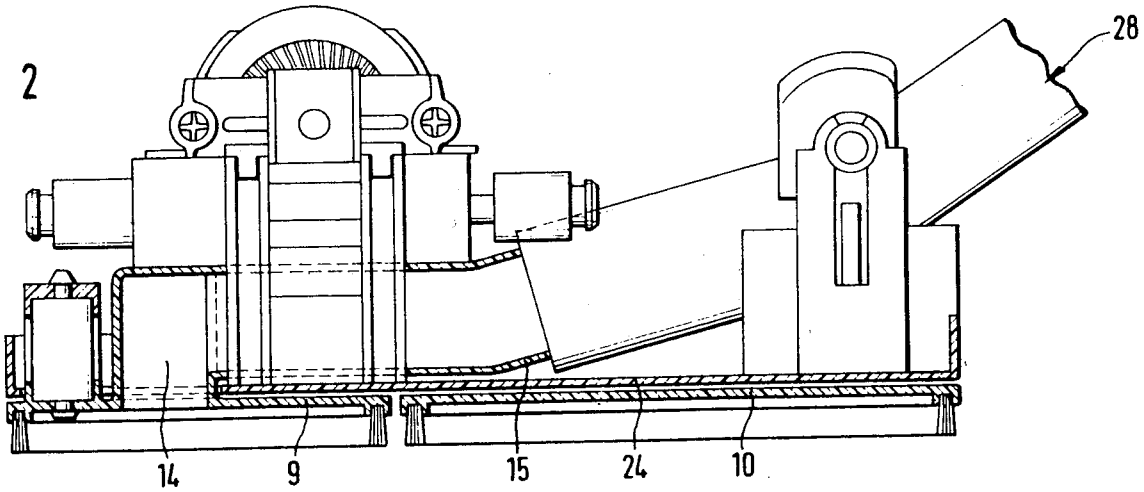
FIG. 2 is a side elevation view of the floor cleaning apparatus of FIG. 1 without the connecting rods.

A motor 2 is shown mounted on a chassis 1 and has two connecting locations (3*a*, 3*b*). Eccenters 4 are mounted on the connecting locations (3*a*, 3*b*) in a form-tight manner and have sliding surfaces on their outer diameters 5. The connecting rods 6 are mounted on respective ones of the eccenters 4. Each connecting rod 6 includes an elastic bending portion 7 and a rotary eccentric movement is translated into a stroke movement 8 via this connecting rod 6. The connecting rods 6 are connected to corresponding ones of the work plates (9, 10). The work plates (9, 10) are guided on elastic rubber bearings 11 to provide a vibration-free stroke movement 8. The rubber bearings 11 are configured so that the bending moment is significantly less in the direction of the stroke movement 8 than in the slide direction 12.

The rubber bearings 11 are received in seats 23 in a form-tight manner so that the transverse movement 8 is not transmitted to the attachment mount 29. An attachment flange 30 is formed on a stem 25 extending from the bearing 11. The attachment flange 30 holds the bearing 11 in its mount 29 and the stem 25 facilitates pulling the flange 30 through the bore 31 when the bearing 11 is mounted in its seat 23.

A rotary-tilt joint 13 is mounted at the rearward region of the chassis 1 such that the weight of the suction means 28 can be braced on the rearward work plate 10 of the apparatus. A suction enclose 14 is formed on the work plate 9 and is connected to the suction means 28 by means of an elastic hose 15 which is guided under the motor 2. Suction is effected only via the forward work plate 9.

The work plates (9, 10) are configured of respectively different sizes because of the different friction relationships between the work plate 9 which operates with a partial vacuum and the work plate 10 in which no partial vacuum is developed. The relationship of the work plate 9 covering approximately one-third of the depth of the apparatus to the work plate 10 extending over approximately two-thirds of the depth of the apparatus results in a uniform contact pressure on the floor.

Figure 4:
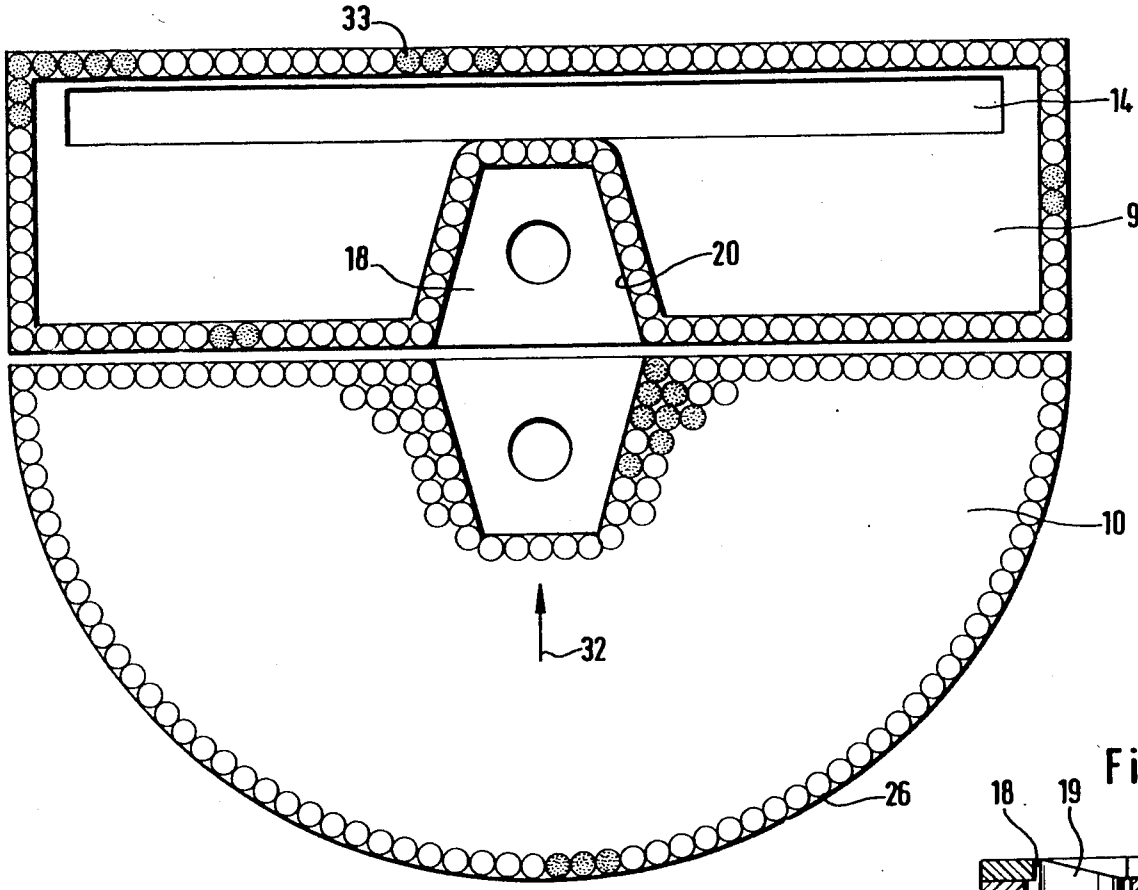
FIG. 4 shows the work plates arranged one next to the other with each of the work plates including latch receiving means; and, FIG. 5 is a cut-out portion of FIG. 4, in section, showing the latch receiving means for the work plates.
Figure 5:
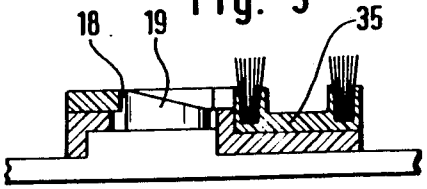

Receiving seats 18 having a latch button 19 are formed on the work plates (9, 10). These receiving seats 18 are conically configured as indicated by reference numeral 20 in FIG. 4. This conical configuration permits the work tool 35 to be pushed onto the work plate 9 much the same as a drawer is inserted into a cabinet.

Figure 3:
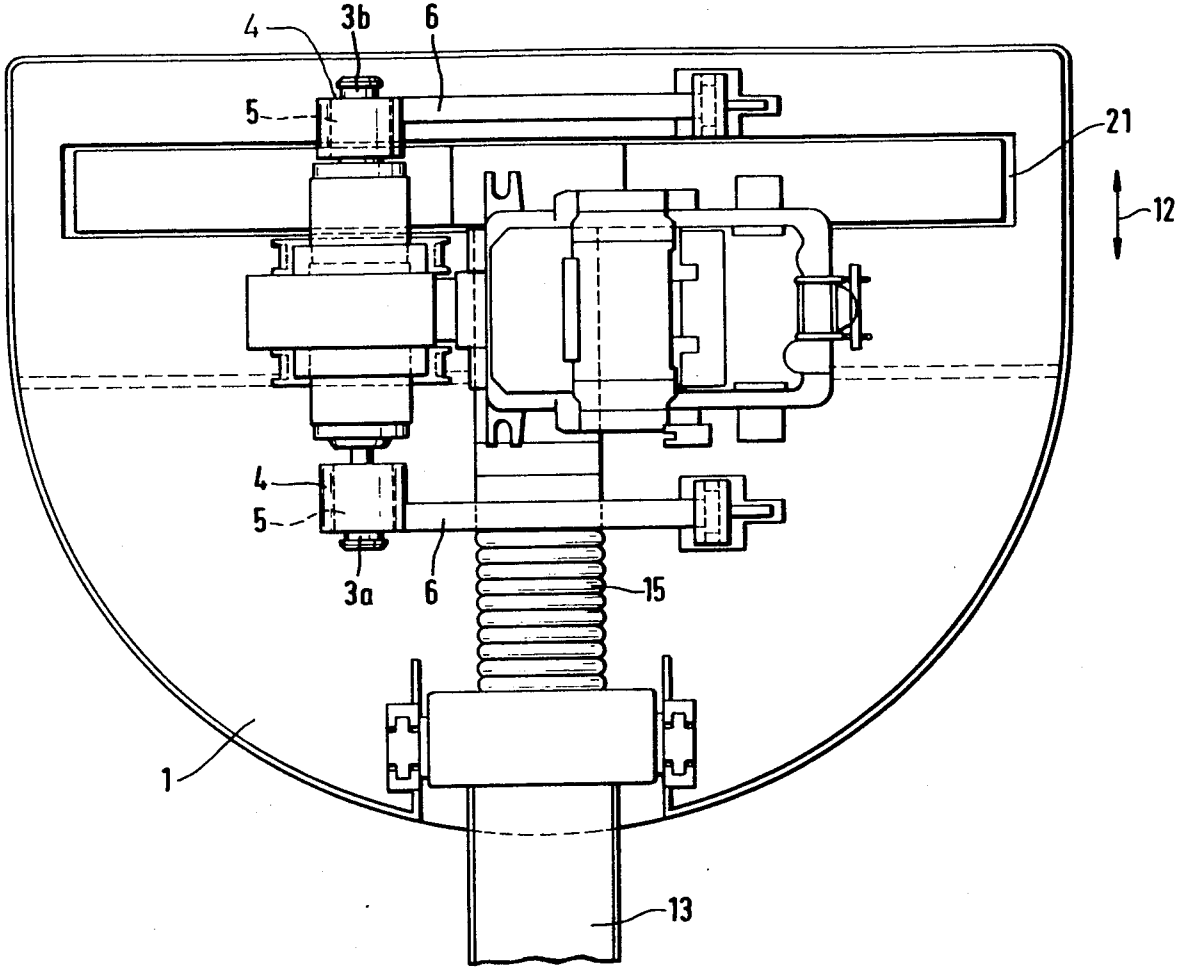
FIG. 3 is a plan view of the floor cleaning apparatus of FIG. 1.

In order to make possible the necessary transverse movement 8, all parts (11, 14, 6) extending through the chassis 1 are provided with appropriate space as indicated by 21 in FIG. 3 for part 14.

The work tools (9, 10) can be appropriately equipped depending upon the particular application. For example, for vacuum cleaning, they can be provided with bristles 33; and for polishing, they can be provided with a steel wool attachment; and for buffing, they can be provided with a buffing cloth attachment.

For apparatus with a speed of movement up to approximately 100 m/min, streaks can be polished with steel wool especially on marble without the entire floor having to be reworked. In order to obtain a uniform polished effect, a continuous drawing away of the loosened wax layer via suction should be provided during the entire working time.

It is important to mount felt or foamed material between the covering and the working tool 35 to provide a uniform and vibration free support of the apparatus on the hard floor when polishing and buffing. The basic form 26 of the rearward portion of work plate 10 is rounded for three reasons:

(a) when the apparatus is pulled back by the operator, the apparatus does not hook or otherwise engage in furniture;

(b) when the apparatus is pulled rearwardly by the operator, the apparatus does not get caught on partitions in the floor notwithstanding the fact that the weight of the vacuum cleaning means is supported on the floor by the plate 10; and, (c) when the apparatus is pivoted at walls (rotary-tilt joint 13), the apparatus glides with greater uniformity at its outer contour along the latter.

It is understood that the foregoing description is that of the preferred embodiments of the invention and that various changes and modifications may be made thereto without departing from the spirit and scope of the invention as defined in the appended claims.

What is claimed is:

1. A floor cleaning apparatus for cleaning a hard floor, the apparatus being movable across the surface of the hard floor by the operator in a desired direction determined by the latter, the apparatus comprising:

a chassis defining a longitudinal axis extending in said desired direction and having a width extending in a direction transverse to said axis;

two work plates for working on said surface of said hard floor, said work plates each having a width corresponding to said width of said chassis and being movably mounted on said chassis so as to perform respective reciprocating movements counter to each other and in a direction transverse to said longitudinal axis thereby causing each of said work plates to perform work on the surface of the floor which corresponds to the whole of the width of said chassis;

one of said work plates being mounted at the forward portion of said chassis and the other one of said work plates being mounted at the rearward portion of said chassis; and, motor means mounted on said chassis for actuating said two work plates to perform said movements.

2. A floor cleaning apparatus movable across the surface of a hard floor by an operator in a desired direction determined by the latter, the apparatus comprising:

a chassis;

two work plates for working on said surface of said hard floor, said work plates being movably mounted on said chassis so as to perform respective reciprocating movements counter to each other and in a direction transverse to said desired direction;

motor means mounted on said chassis for actuating said two work plates to perform said movements;

suction means communicating with one of said work plates for facilitating the establishment of a partial vacuum in the latter; and, said chassis defining a longitudinal axis extending in said desired direction, one of said work plates being mounted at the forward portion of said chassis and the other one of said work plates being mounted at the rearward portion of said chassis, said plates conjointly defining a total depth extending in the direction of said longitudinal axis; said one work plate taking up one-third of said depth; and, said other one of said work plates taking up two-thirds of said depth.

3. The floor cleaning apparatus of claim 2, said suction means being mounted on said chassis so as to be supported above said surface by said other plate; and, said suction means being connected to said one work plate so as to develop a partial vacuum in the latter.

4. The floor cleaning apparatus of claim 3, said one work plate being configured so as to pass air therethrough.

5. The floor cleaning apparatus of claim 3, sealing means being formed on the peripheral edge of each of said work plates.

6. A floor cleaning apparatus movable across the surface of a hard floor by an operator in a desired direction determined by the latter, the apparatus comprising:

a chassis;

two work plates for working on said surface of said hard floor, said work plates being movably mounted on said chassis so as to perform respective reciprocating movements counter to each other and in a direction transverse to said desired direction;

motor means mounted on said chassis for actuating said two work plates to perform said movements;

suction means communicating with one of said work plates for facilitating the establishment of a partial vacuum in the latter; and, first and second elastic bearing means for mounting respective ones of said work plates on said chassis.

7. The floor cleaning apparatus of claim 6, said first elastic bearing means including a plurality of bearings interconnecting said one work plate and said chassis and said second elastic bearing means likewise including a plurality of bearings interconnecting said other work plate with said chassis; each of said bearing being configured so as to have a first elastic bending moment in the x-direction and a second elastic bending moment in the y-direction; said second elastic bending moment being less than said first elastic bending moment.

8. The floor cleaning apparatus of claim 7, said x-direction being parallel to said longitudinal axis.

9. The floor cleaning apparatus of claim 1, said chassis having a length extending in the direction of said longitudinal axis; and, said plates conjointly defining a total depth extending in the direction of said longitudinal axis and corresponding to said length of said chassis.

10. The floor cleaning apparatus of claim 9, comprising suction means communicating with one of said work plates for facilitating the establishment of a partial vacuum in the latter.

11. The floor cleaning apparatus of claim 1, comprising suction means communicating with one of said work plates for facilitating the establishment of a partial vacuum in the latter.

* * * * *

UNITED STATES PATENT AND TRADEMARK OFFICE

CERTIFICATE OF CORRECTION

PATENT NO. : 4,785,492

DATED : November 22, 1988

INVENTOR(S) : Wieland Gühne, Uwe Kemker, Wolfgang Tröger, Hans-Joachim Birr, Paul Michel and Renate Friedrichs It is certified that error appears in the above-identified patent and that said Letters Patent is hereby corrected as shown below:

In the Abstract, line 14: between the words "and" and "work" insert -- one --.

In column 2, line 36: delete "enclose" and substitute -- enclosure -- therefor.

In column 4, line 47: delete "bearing" and substitute -- bearings -- therefor.

Signed and Sealed this

Twenty-fifth Day of April, 1989

*Attest:*

DONALD J. QUIGG

*Attesting Officer*

*Commissioner of Patents and Trademarks*